US010850175B2

(12) United States Patent
Milleman et al.

(10) Patent No.: US 10,850,175 B2
(45) **Date of Patent: *Dec. 1, 2020**

(54) CLUB HEADS WITH VARYING IMPACT RESPONSES AND RELATED METHODS

(71) Applicant: KARSTEN MANUFACTURING CORPORATION, Phoenix, AZ (US)

(72) Inventors: Travis D. Milleman, Portland, OR (US); Martin R. Jertson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/595,313

(22) Filed: Oct. 7, 2019

(65) Prior Publication Data

US 2020/0038719 A1 Feb. 6, 2020

Related U.S. Application Data

(63) Continuation of application No. 16/162,750, filed on Oct. 17, 2018, now Pat. No. 10,471,312, which is a (Continued)

(51) Int. Cl.
*A63B 53/04* (2015.01)

(52) U.S. Cl.
CPC ..... *A63B 53/047* (2013.01); *A63B 53/0475* (2013.01); *A63B 2053/0408* (2013.01); (Continued)

(58) Field of Classification Search
CPC ..... A63B 53/047; A63B 2053/0445; A63B 2053/0495; A63B 2053/0416; (Continued)

(56) References Cited

U.S. PATENT DOCUMENTS 5,290,036 A 3/1994 Fenton et al.
5,398,929 A 3/1995 Kitaichi
(Continued)

FOREIGN PATENT DOCUMENTS

JP 2004313777 11/2004
JP 2011030837 2/2011
(Continued)

*Primary Examiner* — Sebastiano Passaniti

(57) ABSTRACT

Some embodiments include a golf club head. The golf club head includes a front body having a front body front portion with a front body front surface and having a front body rear portion, and includes a rear body having a rear body front portion, a rear body rear portion, and multiple protrusions. The golf club head is configured such that (i) when the front body front surface strikes a golf ball with a first amount of force, the front body deflects toward the rear body with a first amount of deflection, and (ii) when the front body front surface strikes the golf ball with a second amount of force less than the first amount of force, the front body deflects toward the rear body with a second amount of deflection greater than the first amount of deflection. Other embodiments of related club heads and methods are also disclosed.

20 Claims, 6 Drawing Sheets

Related U.S. Application Data continuation of application No. 15/273,560, filed on Sep. 22, 2016, now Pat. No. 10,130,851.

(60) Provisional application No. 62/221,980, filed on Sep. 22, 2015.

(52) U.S. Cl.
CPC ..... *A63B 2053/0416* (2013.01); *A63B 2053/0445* (2013.01); *A63B 2053/0479* (2013.01); *A63B 2053/0495* (2013.01); *A63B 2209/00* (2013.01)

(58) Field of Classification Search
CPC ..... A63B 53/0475; A63B 2053/0479; A63B 2053/0408; A63B 2209/00
USPC ..... 473/324–350, 287–292
See application file for complete search history.

(56) References Cited

U.S. PATENT DOCUMENTS

| | | | |
|---|---|---|---|
| 6,193,615 | B1 | 2/2001 | Hirota |
| 6,743,117 | B2 | 6/2004 | Gilbert |
| 6,932,716 | B2 | 8/2005 | Ehlers et al. |
| 7,083,530 | B2 | 8/2006 | Wahl et al. |
| 7,278,926 | B2 | 10/2007 | Frame |
| 7,281,990 | B2 | 10/2007 | Hagood et al. |
| 7,364,513 | B2 | 4/2008 | Krumme |
| 7,367,898 | B2 | 5/2008 | Hawkins et al. |
| 7,611,423 | B2 | 3/2009 | Matsunaga et al. |
| 7,651,408 | B2 | 1/2010 | Hagood et al. |
| 7,708,653 | B2 | 5/2010 | Hawkins et al. |
| 7,713,139 | B1 | 5/2010 | Stites et al. |
| 7,717,801 | B2 | 5/2010 | Franklin et al. |
| 7,871,338 | B2 | 1/2011 | Nakano |
| 7,914,394 | B2 | 3/2011 | Cole et al. |
| 8,088,025 | B2 | 3/2012 | Wahl et al. |
| 8,206,237 | B2 | 6/2012 | Gilbert et al. |
| 8,267,807 | B2 | 9/2012 | Takechi |
| 8,152,651 | B2 | 10/2012 | Roach |
| 8,328,660 | B2 | 11/2012 | Roberts et al. |
| 8,663,028 | B2 | 4/2014 | Nakano et al. |
| 8,876,630 | B2 | 4/2014 | Takechi |
| 8,715,097 | B2 | 6/2014 | Knafel |
| 8,753,223 | B2 | 6/2014 | Stites |
| 8,852,023 | B2 | 7/2014 | Stites et al. |
| 8,915,799 | B2 | 12/2014 | Hebert et al. |
| 8,974,317 | B1 | 3/2015 | Griffin et al. |
| 8,979,667 | B1 | 3/2015 | Tipton |
| 9,022,880 | B2 | 5/2015 | Kawaguchi et al. |
| 9,033,817 | B2 | 5/2015 | Snyder |
| 9,089,747 | B2 | 7/2015 | Boyd et al. |
| 9,168,437 | B2 | 10/2015 | Roach et al. |
| 9,330,406 | B2 | 3/2016 | Soracco et al. |
| 9,409,065 | B2 | 8/2016 | Morales et al. |
| 10,130,851 | B2 * | 11/2018 | Milleman ..... A63B 53/047 |
| 10,471,312 | B2 * | 11/2019 | Milleman ..... A63B 53/047 |
| 2005/0009623 | A1 | 1/2005 | Dickinson |
| 2005/0020378 | A1 | 1/2005 | Krumme et al. |
| 2007/0155534 | A1 | 5/2007 | Tsai et al. |
| 2009/0023513 | A1 | 1/2009 | Shibata et al. |
| 2011/0014996 | A1 | 1/2011 | Shepherd et al. |
| 2011/0070963 | A1 | 3/2011 | Fedorochko et al. |
| 2012/0088599 | A1 | 12/2012 | Narita et al. |
| 2013/0109500 | A1 | 2/2013 | Boyd et al. |
| 2014/0038744 | A1 | 6/2014 | Leat et al. |
| 2015/0065267 | A1 | 5/2015 | Wahl et al. |
| 2015/0133232 | A1 | 5/2015 | Taylor et al. |

FOREIGN PATENT DOCUMENTS

| | | |
|---|---|---|
| JP | 5021825 | 12/2012 |
| JP | 2014073158 | 4/2014 |

* cited by examiner

CLUB HEADS WITH VARYING IMPACT RESPONSES AND RELATED METHODS

CROSS-REFERENCE OF RELATED APPLICATIONS

This is a continuation of U.S. application Ser. No. 16/162,750, filed Oct. 17, 2018, which is a continuation of U.S. application Ser. No. 15/273,560, filed on Sep. 22, 2016, now U.S. Pat. No. 10,130,851, issued Nov. 20, 2018, which claims the benefit of U.S. Provisional Patent Application No. 62/221,980, filed on Sep. 22, 2015, the contents of which are fully incorporated herein by reference.

TECHNICAL FIELD

This disclosure relates generally to sports equipment, and relates more particularly to golf club heads and related methods.

BACKGROUND

Vertical spin of a golf ball can generate lifting forces on the golf ball that can influence the golf ball's travel height and/or travel distance when hit with a golf club. For example, increasing vertical spin on the golf ball can increase the lifting forces on the golf ball, thereby increasing the travel height and/or decreasing the travel distance of the golf ball. Meanwhile, decreasing vertical spin on the golf ball can decrease the lifting forces on the golf ball, thereby decreasing the travel height and/or increasing the travel distance of the golf ball.

The coefficient of restitution (COR) of a club face of a club head of the golf club that hits the golf ball also can influence the travel speed of the golf ball, thereby influencing the golf ball's travel distance. COR refers to a relationship of the energy transfer of two colliding objects (e.g., the club face and the golf ball) and can be represented as a ratio of the relative speed of the objects after collision over the relative speed of the objects before collision. As COR depends on the relative speed of the objects before and after collision, it follows that the velocity with which the club face impacts the golf ball can affect the COR of the club face. In general, increasing the COR of the club face can increase travel speed of the golf ball, thereby increasing travel distance of the golf ball, and decreasing the COR of the club face can decrease travel speed of the golf ball, thereby decreasing travel distance of the golf ball.

Different travel distances and/or travel heights may be desired for different golf shots, to achieve different results. For example, for longer shots, a higher COR of the club face and/or less vertical spin (i.e., less lift) of the golf ball may be desirable; whereas, for shorter shots and/or for more accurate shots, a lower COR of the club face and/or more vertical spin (i.e., more lift) of the golf ball may be desirable. Accordingly, there is a need in the art for a golf club head able to provide differing impact responses (e.g., COR of a club face of the golf club head and/or vertical spin of a golf ball hit with the golf club head) for higher and lower forces of impact between the golf club head and the golf ball. As a result, different golf shots can be achieved with the golf club head by adjusting the force of impact between the golf club head and the golf ball.

BRIEF DESCRIPTION OF THE DRAWINGS

To facilitate further description of the embodiments, the following drawings are provided in which.

Figure 1:
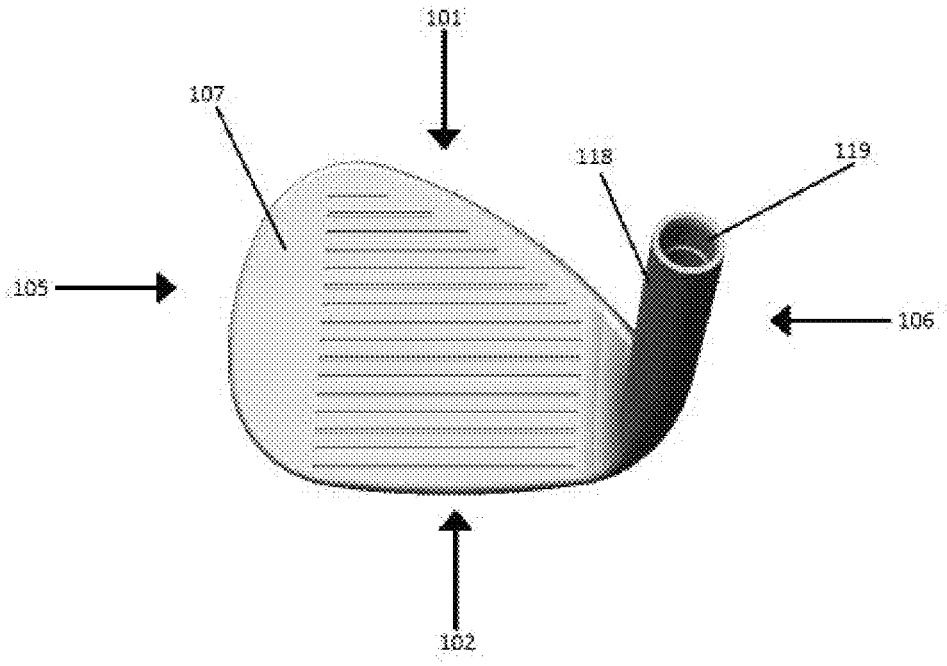
FIG. 1 illustrates a front view of a club head, according to an embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The absence of the word "removably," "removable," and the like near the word "coupled," and the like does not mean that the coupling, etc. in question is or is not removable.

DESCRIPTION

Some embodiments include a golf club head. The golf club head comprises a top end, a bottom end opposite the top end, a front end, a rear end opposite the front end, a toe end, and a heel end opposite the toe end. Further, the golf club head comprise a front body and a rear body. The front body comprises a front body front portion comprising a front body front surface, and comprises a front body rear portion opposite the front body front portion. The front body front portion can be located closer to the front end than is the front body rear portion. Meanwhile, the rear body comprises a rear body front portion comprising a rear body front surface, and comprises a rear body rear portion opposite the rear body front portion. The rear body rear portion can be located closer to the rear end than is the rear body front portion. Also, the rear body comprises multiple protrusions. Each protrusion of the multiple protrusions can comprise a first end and a second end opposite the first end. The second end of the each protrusion of the multiple protrusions can be coupled to the rear body front portion at the rear body front surface or the front body rear portion at the front body rear surface. Meanwhile, the front body can be configured to be coupled to the rear body. When the front body is coupled to the rear body, (i) when the second end of the each protrusion of the multiple protrusions is coupled to the rear body front portion at the rear body front surface, the each protrusion can extend away from the rear body front portion toward the front body rear portion, and (ii) when the second end of the each protrusion of the multiple protrusions is coupled to the front body rear portion at the front body rear surface, the each protrusion can extend away from the front body rear portion toward the rear body front portion. Further, when the front body is coupled to the rear body, the golf club head can be configured such that: (i) when the second end of the each protrusion of the multiple protrusions is coupled to the rear body front portion at the rear body front surface, and when the front body front surface strikes a golf ball with a first amount of force, the multiple protrusions deflect toward the rear body with a first amount of deflection; (ii) when the second end of the each protrusion of the multiple protrusions is coupled to the front body rear portion at the front body rear surface, and when the front body front surface strikes a golf ball with a second amount of force, the multiple protrusions deflect toward the front body with a second amount of deflection; (iii) when the second end of the each protrusion of the multiple protrusions is coupled to the rear body front portion at the rear body front surface, and when the front body front surface strikes the golf ball with a third amount of force, the multiple protrusions deflect toward the rear body with a third amount of deflection; and (iv) when the second end of the each protrusion of the multiple protrusions is coupled to the front body rear portion at the front body rear surface, and when the front body front surface strikes the golf ball with a fourth amount of force, the multiple protrusions deflect toward the rear body with a fourth amount of deflection. Also, the first amount of force is greater than the third amount of force, the second amount of force is greater than the fourth amount of force, the first amount of deflection is less than the third amount of deflection, and the second amount of deflection is less than the fourth amount of deflection.

Other embodiments include a method of providing a golf club head. The method can comprise: providing a front body of the golf club head; and providing a rear body of the golf club head. The golf club head can comprise a top end, a bottom end opposite the top end, a front end, a rear end opposite the front end, a toe end, and a heel end opposite the toe end. Meanwhile, providing the front body can comprise: providing a front body front portion comprising a front body front surface; and providing a front body rear portion opposite the front body front portion, the front body front portion being located closer to the front end than is the front body rear portion. Also, providing the rear body can comprise: providing a rear body front portion comprising a rear body front surface; providing a rear body rear portion opposite the rear body front portion, the rear body rear portion being located closer to the rear end than is the rear body front portion; and providing multiple protrusions. Each protrusion of the multiple protrusions can comprise a first end and a second end opposite the first end. The second end of the each protrusion of the multiple protrusions can be coupled to the rear body front portion at the rear body front surface or the front body rear portion at the front body rear surface. Meanwhile, the front body can be configured to be coupled to the rear body. When the front body is coupled to the rear body, (i) when the second end of the each protrusion of the multiple protrusions is coupled to the rear body front portion at the rear body front surface, the each protrusion can extend away from the rear body front portion toward the front body rear portion, and (ii) when the second end of the each protrusion of the multiple protrusions is coupled to the front body rear portion at the front body rear surface, the each protrusion can extend away from the front body rear portion toward the rear body front portion. Further, when the front body is coupled to the rear body, the golf club head can be configured such that: (i) when the second end of the each protrusion of the multiple protrusions is coupled to the rear body front portion at the rear body front surface, and when the front body front surface strikes a golf ball with a first amount of force, the multiple protrusions deflect toward the rear body with a first amount of deflection; (ii) when the second end of the each protrusion of the multiple protrusions is coupled to the front body rear portion at the front body rear surface, and when the front body front surface strikes a golf ball with a second amount of force, the multiple protrusions deflect toward the front body with a second amount of deflection; (iii) when the second end of the each protrusion of the multiple protrusions is coupled to the rear body front portion at the rear body front surface, and when the front body front surface strikes the golf ball with a third amount of force, the multiple protrusions deflect toward the rear body with a third amount of deflection; and (iv) when the second end of the each protrusion of the multiple protrusions is coupled to the front body rear portion at the front body rear surface, and when the front body front surface strikes the golf ball with a fourth amount of force, the multiple protrusions deflect toward the rear body with a fourth amount of deflection. Also, the first amount of force is greater than the third amount of force, the second amount of force is greater than the fourth amount of force, the first amount of deflection is less than the third amount of deflection, and the second amount of deflection is less than the fourth amount of deflection.

Further embodiments include a golf club head. The golf club head comprises a top end, a bottom end opposite the top end, a front end, a rear end opposite the front end, a toe end, and a heel end opposite the toe end. Further, the golf club head comprise a front body and a rear body. The front body comprises a front body front portion comprising a front body front surface, and comprises a front body rear portion opposite the front body front portion. The front body front portion can be located closer to the front end than is the front body rear portion. Meanwhile, the rear body comprises a rear body front portion comprising a rear body front surface, and comprises a rear body rear portion opposite the rear body front portion. The rear body rear portion can be located closer to the rear end than is the rear body front portion. The front body can be configured to be coupled to the rear body. When the front body is coupled to the rear body, the golf club head can be configured such that (a) when the front body front surface strikes a golf ball with a first amount of force, the front body front portion deflects toward the rear body with a first amount of deflection, and (b) when the front body front surface strikes the golf ball with a second amount of force, the front body front portion deflects toward the rear body with a second amount of deflection. Meanwhile, the first amount of force can be greater than the second amount of force, and the first amount of deflection can be less than the second amount of deflection.

Figure 2:
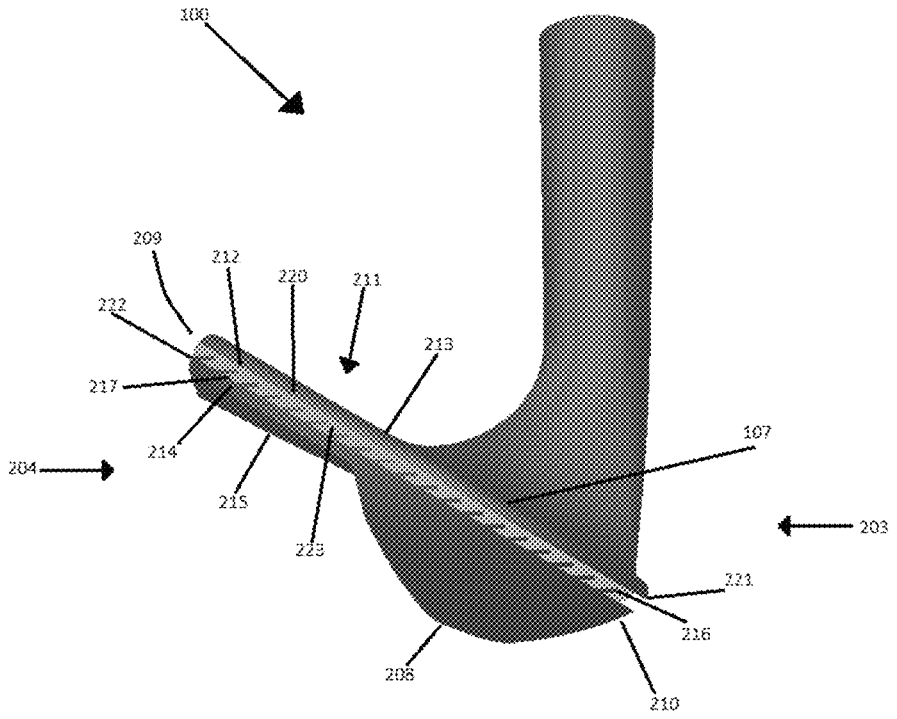
FIG. 2 illustrates a toe side view of the club head of FIG. 1.
Figure 3:
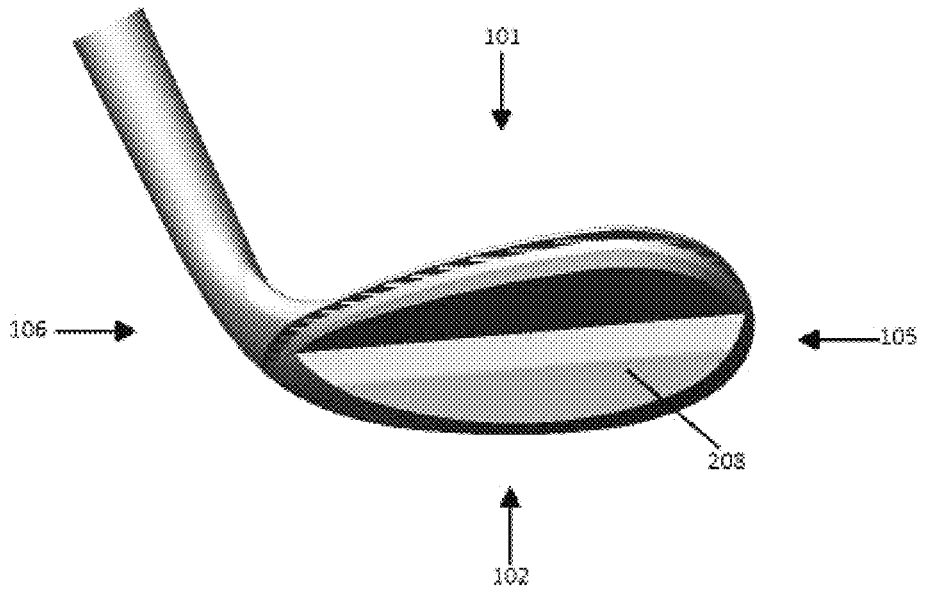
FIG. 3 illustrates a rear view of the club head of FIG. 1.

Turning to the drawings, FIGS. 1-3 illustrate front, heel side, and rear views of a club head 100, according to an embodiment. Club head 100 is merely exemplary and is not limited to the embodiments presented herein. Club head 100 can be employed in many different embodiments or examples not specifically depicted or described herein.

Generally, club head 100 can comprise a golf club head. In many embodiments, club head 100 can comprise any suitable iron-type golf club head. For example, in these or other embodiments, club head 100 can comprise a muscle-back iron-type golf club head or cavity-back iron-type golf club head. In further embodiments, club head 100 can comprise any suitable wedge iron-type golf club head. Meanwhile, although club head 100 is generally described with respect to a iron-type golf club head, in other embodiments, club head 100 can comprise any other suitable type of golf club head, such as, for example, a wood-type golf club head (e.g., a driver club head, a fairway wood club head, a hybrid club head, etc.) or a putter golf club head. Notwithstanding the foregoing, the apparatus and the methods and articles of manufacture described herein are not limited in this regard.

Referring to FIG. 1, club head 100 comprises a top end 101, a bottom end 102 opposite top end 101, a front end 203 (FIG. 2), a rear end 204 (FIG. 2) opposite front end 203, a toe end 105, and a heel end 106 opposite toe end 105. Further, club head 100 comprises a front body 107 and a rear body 208 (FIG. 2). In some embodiments, described further below, the front body 107 or the rear body 208 can comprise multiple protrusions 216. Further, in some embodiments, the club head 100 can comprise a filler material 223 positioned between the front body 107 and the back body 208 and the multiple protrusions 216. Also, club head 100 can comprise a shaft receiving structure 118.

In some embodiments, although a shaft is not illustrated at the drawings, shaft receiving structure 118 can comprise a hosel or any other suitable mechanism (e.g., a bore) for receiving and coupling a shaft (e.g. a golf club shaft) to club head 100. In these or other embodiments, the shaft can be coupled to club head 100 as part of a golf club.

Figure 8:
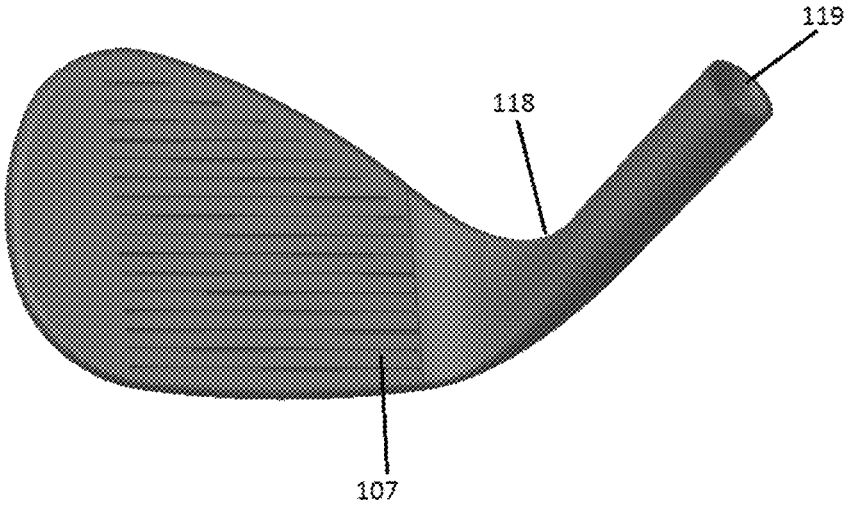
FIG. 8 illustrates a front view of a club head, according to another embodiment, wherein the rear body comprises the shaft receiving structure.
Figure 9:
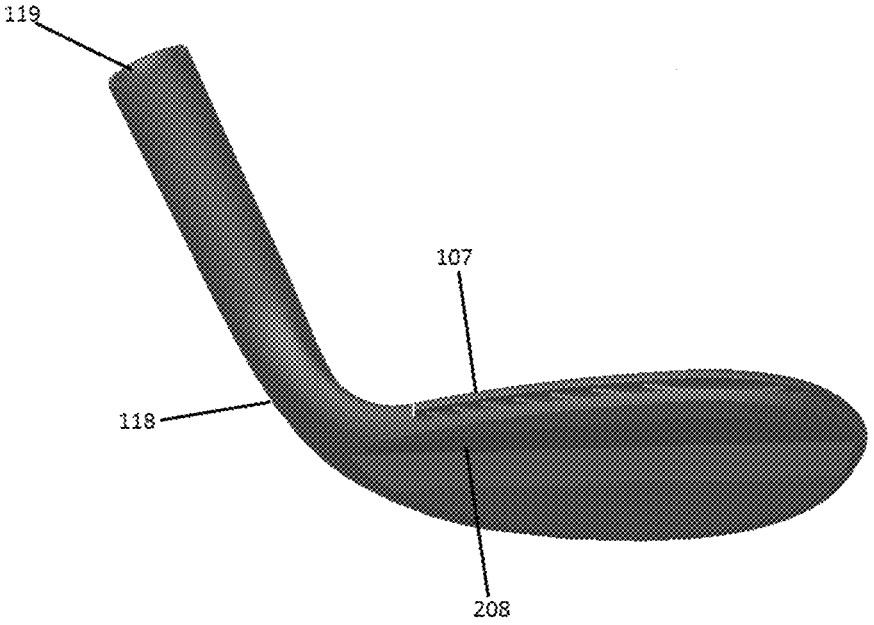
FIG. 9 illustrates a rear view of the club head of FIG. 8.
Figure 10:
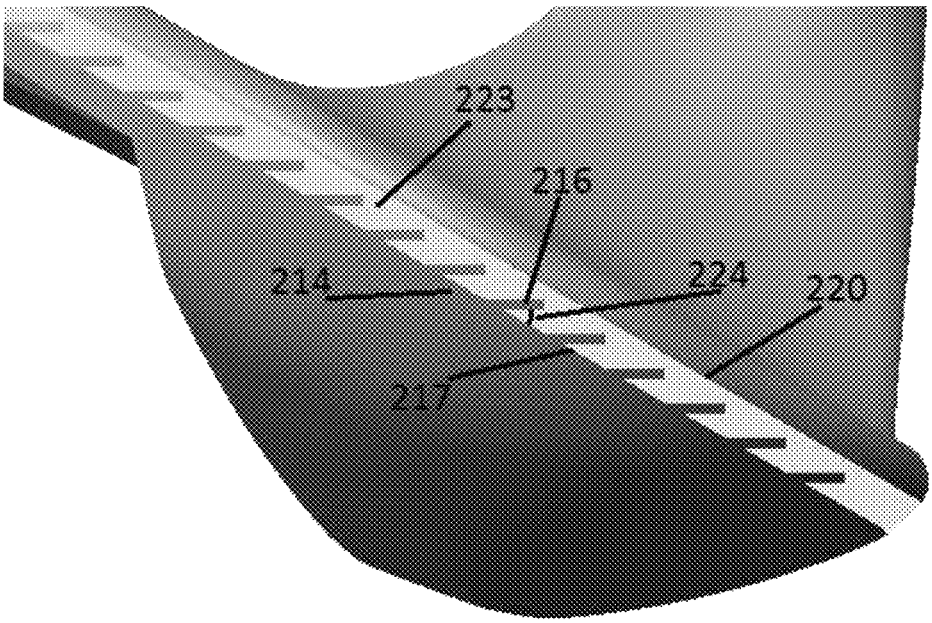
FIG. 10 illustrates a close up, toe view of the club head of FIG. 1.
Figure 11:
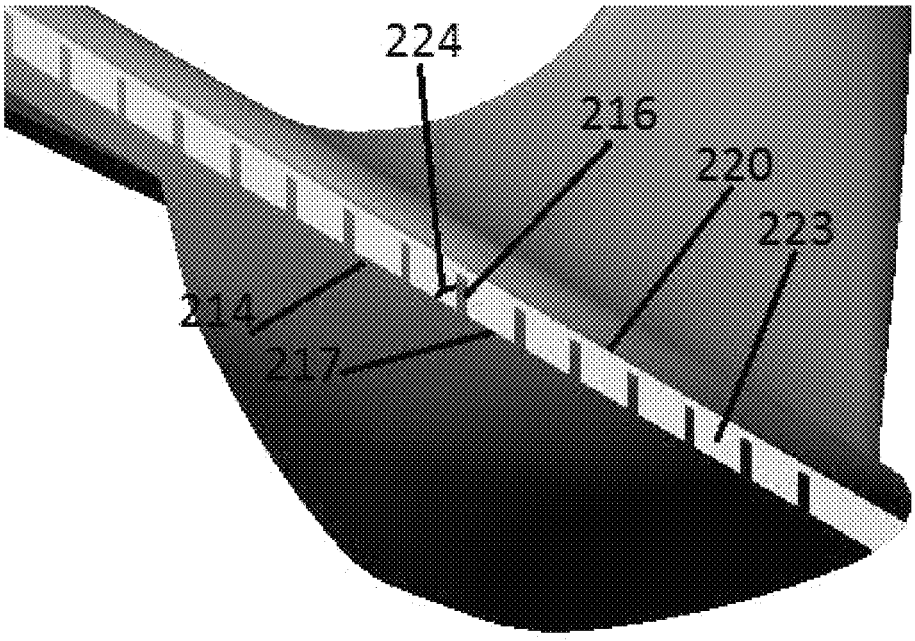
FIG. 11 illustrates a close up, toe view of another embodiment of the club head, wherein the multiple protrusions extend towards a top end of the club head.

Shaft receiving structure 118 can be configured to receive the shaft via an opening 119 of shaft receiving structure 118. Accordingly, shaft receiving structure 118 and/or opening 119 can receive the shaft and permit the shaft to be coupled (e.g., permanently or removably) to club head 100 when shaft receiving structure 118 and/or opening 119 receives the shaft. In many embodiments, referring to FIGS. 1-3, the front body 107 can comprise the shaft receiving structure 118. In other embodiments, referring to FIGS. 8 and 9, the rear body 208 can comprise the shaft receiving structure 118. In some embodiments, the shaft receiving structure 118 can be located at or proximate to heel end 106.

In operation, club head 100 can be positioned in an address configuration. In some embodiments, the address configuration can refer to a configuration of club head 100 in which club head 100 is positioned to address a golf ball (not shown) while club head 100 is in a resting state. Further, in these or other embodiments, the address configuration can refer to a configuration of club head 100 in which club head 100 is balanced (e.g., at a sole portion 210 (FIG. 2)) on a level surface (e.g., a ground surface) and acted upon only by gravity. Further still, in these or other embodiments, club head 100 can be decoupled from the shaft.

For reference purposes, when at the address configuration, club head 100 can comprise a shaft axis. The shaft axis can refer to a reference axis (a) that can be orthogonal to opening 119 and (b) that can intersect a center point of opening 119 or a central axis of the tubular cavity within shaft receiving structure 118. When a shaft is coupled to club head 100, the shaft and the shaft axis can be approximately parallel and/or co-linear.

The shaft axis can comprise a top-to-bottom axis, a heel-to-toe axis, and a front-to-rear axis. The top-to-bottom axis, the heel-to-toe axis, and the front-to-rear axis can provide a Cartesian reference frame for club head 100 as component axes of the shaft axis. In these embodiments, the top-to-bottom axis, the heel-to-toe axis, and the front-to-rear axis each can be orthogonal to each other. Further, the top-to-bottom axis can extend approximately in a direction of top end 101 and bottom end 102; the heel-to-toe axis can extend approximately in a direction of heel end 106 and toe end 105 and/or the front-to-rear axis can extend approximately in a direction of front end 203 (FIG. 2) and rear end 204 (FIG. 2).

Meanwhile, club head 100 can comprise a lie angle and a loft angle. In these embodiments, the shaft axis can form a lie angle with a ground plane, and a loft plane can form the loft angle with the shaft axis. Further, club head 100 can comprise one or more keel points and one or more leading edge points. Further still, the top-to-bottom axis can be approximately orthogonal to the ground plane, the heel-to-toe axis can be approximately parallel to the ground plane, and/or the front-to-rear axis can be approximately parallel to the ground plane.

The ground plane can refer to a plane (a) that is parallel to a plane including the heel-to-toe axis and the front-to-rear axis when club head 100 is positioned in the address configuration and (b) that intersects or is tangent to the keel point(s). Meanwhile, the keel point(s) can refer to the point or points of sole portion 210 (FIG. 2) closest to bottom end 102 and farthest from top end 101 when club head 100 is positioned in the address configuration. Further, the leading edge point(s) can refer to the point or points of sole portion 210 (FIG. 2) that are closest to front end 203 (FIG. 2) and farthest from rear end 204 (FIG. 2) when club head 100 is positioned in the address configuration. For purposes of clarity, the keel point(s) can comprise a single point in some examples, but also can comprise multiple points if each of the multiple points are equally close to bottom end 102 and far from top end 101, and the leading edge point(s) can comprise a single point in some examples, but also can comprise multiple points if each of the multiple points are equally close to front end 203 (FIG. 2) and far from rear end 204 (FIG. 2).

Meanwhile, the loft plane can refer to a plane (a) that intersects the leading edge point(s) and (b) that is approximately parallel with a front body front surface 213 (FIG. 2)

when club head 100 is positioned in the address configuration. In these or other embodiments, the loft plane can refer to a plane (a) that intersects a face center of front body front surface 213 (FIG. 2) and (b) that is approximately parallel with front body front surface 213 (FIG. 2) when club head 100 is positioned in the address configuration. In many examples, the face center can refer to a location at front body front surface 213 (FIG. 2) that is equidistant between toe end 105 and heel end 106 and further that is equidistant between top end 101 and bottom end 102. In various examples, the face center can refer to the face center as defined at *United States Golf Association: Procedure for Measuring the Flexibility of a Golf Clubhead*, USGA-TPX 3004, Revision 1.0.0, p. 6, May 1, 2008 (retrieved Sep. 13, 2015 from http://usga.org/equipment/testing/protocols/Test-Protocols-for-Equipment/), which is incorporated herein by reference. When front body front surface 213 (FIG. 2) is planar and/or substantially planar, front body front surface 213 (FIG. 2) and the loft plane can be approximately co-planar. Meanwhile, if front body front surface 213 (FIG. 2) is non-planar (e.g., curved), at least part of front body front surface 213 (FIG. 2) can be located in front of or behind the loft plane.

In many embodiments, a type of club head of club head 100 can be identified according to the loft angle. In these or other embodiments, the loft angle can be greater than or equal to approximately 0 degrees and less than or equal to approximately 65 degrees. In some embodiments, the loft angle can be greater than or equal to approximately 20 degrees, greater than or equal to approximately 25 degrees, greater than or equal to approximately 30 degrees, greater than or equal to approximately 35 degrees, greater than or equal to approximately 40 degrees, greater than or equal to approximately 45 degrees, greater than or equal to approximately 50 degrees, greater than or equal to approximately 55 degrees, greater than or equal to approximately 60 degrees, greater than or equal to approximately 65 degrees, greater than or equal to approximately 70 degrees, or greater than or equal to approximately 75 degrees. The loft angle can be 20 degrees, 25 degrees, 30 degrees, 35 degrees, 40 degrees, 45 degrees, 50 degrees, 55 degrees, 60 degrees, 65 degrees, 70 degrees, or 75 degrees. When club head 100 comprises a wedge iron-type golf club head, the loft angle can be greater than or equal to approximately 45 degrees and less than or equal to approximately 65 degrees. For example, the loft angle of a wedge iron-type golf club head can be greater than or equal to approximately 45 degrees, greater than or equal to approximately 47.5 degrees, greater than or equal to approximately 50 degrees, greater than or equal to approximately 52.5 degrees, greater than or equal to approximately 55 degrees, greater than or equal to approximately 57.5 degrees, greater than or equal to approximately 60 degrees, greater than or equal to approximately 62.5 degrees, or greater than or equal to approximately 65 degrees. The loft angle can be 45 degrees, 47.5 degrees, 50 degrees, 52.5 degrees, 55 degrees, 57.5 degrees, 60 degrees, 62.5 degrees, or 65 degrees. Further, the lie angle can be greater than or equal to approximately 50 degrees and less than or equal to approximately 70 degrees.

Turning now to FIG. 2, club head 100 can comprise a top portion 209, which can be referred to as a top rail, and sole portion 210. For example, top portion 209 can be located at or proximate to top end 101 and sole portion 210 can be located at or proximate to bottom end 102. In these embodiments, front body 107 and/or rear body 208 can comprise top portion 109; and/or front body 107 and/or rear body 208 can comprise sole portion 110.

In many embodiments, front body 107 can comprise a front body front portion 211, a front body rear portion 212, and multiple protrusions 216. Further, front body front portion 211 can comprise front body front surface 213. Further still, in some embodiments, front body rear portion 212 can comprise or consist of a front body rear surface 220, and can comprise a front body perimeter edge 221. In some embodiments, the front body rear surface 220 can comprise multiple protrusions 216.

In these or other embodiments, rear body 208 can comprise a rear body front portion 214, a rear body rear portion 215, and multiple protrusions 216. Further, rear body front portion 214 can comprise or consist of a rear body front surface 217, and can comprise a rear body perimeter edge 222. In many embodiments, rear body front surface 217 can comprise multiple protrusions 216. In the same or different embodiments, front body rear surface 220 can comprise multiple protrusions 216.

In these or other embodiments, front body rear portion 212 can be opposite front body front portion 211. In some embodiments, front body front portion 211 and front body front surface 213 can be located at or proximate to front end 203. In further embodiments, front body front portion 211 and front body rear portion 212 can be located with front body front portion 211 being closer to front end 203 than is front body rear portion 212. Front body perimeter edge 221 can surround (e.g., frame) front body rear portion 212, and can define an outermost boundary of front body rear portion 212.

In these or other embodiments, rear body rear portion 215 can be opposite rear body front portion 214. In some embodiments, rear body rear portion 215 can be located at or proximate to rear end 204. In further embodiments, rear body front portion 214 and rear body rear portion 215 can be located with rear body rear portion 215 being closer to rear end 204 than is rear body front portion 214. Rear body perimeter edge 222 can surround (e.g., frame) rear body front portion 214, and can define an outermost boundary of rear body front portion 214.

Front body front surface 213 can refer to a strike face of club head 100, and can be configured to impact a golf ball (not shown). The strikeface of club head 100 can include a strikeface thickness. In some embodiments, the strikeface thickness can be less that 0.09 in, less that 0.08 in, less than 0.07 in, less than 0.06 in, or less than 0.05 in. For example, in some embodiments the strikeface thickness can be between 0.07-0.09 in, 0.06-0.08 in, or 0.05-0.07 in. The strikeface thickness can be 0.09 in, 0.08 in, 0.07 in, 0.06 in, or 0.05 in. In many embodiments, front body front surface 213 can refer to a land area of front body front portion 211. Further, front body front surface 213 can comprise one or more grooves. In these or other embodiments, the groove(s) can extend between toe end 105 and heel end 106. Further, when the groove(s) comprise multiple grooves, two or more grooves of the groove(s) can be approximately parallel to each other. In some embodiments, the groove(s) can be referred to as one or more scoring lines.

Meanwhile, in many embodiments, front body rear surface 220 can refer to a land area of front body rear portion 212. In further embodiments, front body rear surface 220 can be approximately parallel to front body front surface 213. In these or other embodiments, front body front surface 213 and/or front body rear surface 220 can be planar or substantially planar. Accordingly, in some embodiments, when front body front region 211 comprises front body front surface 213, and when front body rear region 212 comprises front body rear surface 220, the portion of front body 107 between front body front surface 213 and front body rear surface 220 can comprise a strike plate.

In many embodiments, rear body 208 can be solid. However, in some embodiments, rear body 208 can be hollow or partially hollow. When rear body 208 is hollow or partially hollow, rear body 208 can comprise a shell structure. In these embodiments, rear body 208 can be filled and/or partially filled with a shell structure filler material different from a material of the shell structure. For example, the shell structure filler material can comprise plastic foam.

In further embodiments, rear body front surface 217 can refer to a land area of rear body front portion 214. In these or other embodiments, rear body front surface 217 can be planar or substantially planar. Further, rear body front surface 217 can be approximately parallel to front body front surface 213 and/or front body rear surface 220.

Although FIGS. 1-3 illustrate rear body front portion 208 consisting of rear body front surface 217, in other embodiments in which rear body front portion 214 comprises rear body front surface 217, rear body front surface 217 can be recessed from one or more other surfaces (e.g., one or more perimeter surface(s)) of rear body front portion 214. In these or other embodiments, the perimeter surface(s) can at least partially surround (e.g., frame) rear body front surface 217, and rear body front surface 217 can be recessed from the perimeter surface(s) such that rear body front surface 217 is closer to rear body rear portion 215 than are the perimeter surface(s). For example, when the perimeter surface(s) entirely surround (e.g., frame) rear body front surface 217, rear body 208 and/or rear body front portion 214 can comprise a cavity at least partially bounded by rear body front surface 217 and one or more side walls extending between rear body front surface 217 and the perimeter surface(s).

In some embodiments, each protrusion of multiple protrusions 216 can be coupled to rear body front portion 214 at rear body front surface 217. For example, each protrusion of multiple protrusions 216 can be coupled to rear body front portion 214 and/or rear body front surface 217 at a first end of the protrusion of multiple protrusions 216. Meanwhile, in these or other embodiments, each protrusion of multiple protrusions 216 can extend out and away from rear body front portion 214 and/or rear body front surface 217.

Figure 12:
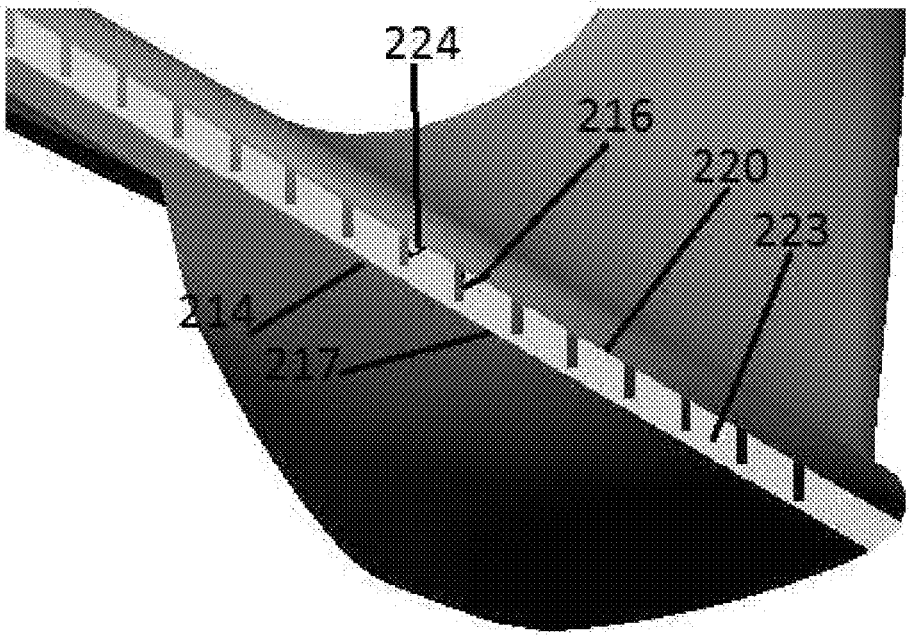
FIG. 12 illustrates a close up, toe view of another embodiment of the club head, wherein the multiple protrusions extend from the front body rear surface.

In other embodiments, referring to FIG. 12, each protrusion of multiple protrusions 216 can be coupled to front body rear portion 212 at front body rear surface 220. For example, each protrusion of multiple protrusions 216 can be coupled to front body rear portion 212 and/or front body rear surface 220 at a first end of the protrusion of multiple protrusions 216. Meanwhile, in these or other embodiments, each protrusion of multiple protrusions 216 can extend out and away from front body rear portion 212 and/or front body rear surface 220.

Front body 107 can be connected or coupled to rear body 208 using any suitable manner of connecting or coupling. In many embodiments, part or all of front body perimeter edge can be coupled to part or all of rear body perimeter edge 222 in order to couple front body 107 to rear body 208. In other embodiments, at least a portion of front body rear surface 220 can be coupled to at least a portion of rear body front surface 217 using a plurality of coupling mechanisms.

For example, in some embodiments, the front body 107 can be coupled to the rear body 208 by way of the multiple protrusions 216. To couple the front body 107 and the rear body 208 using the multiple protrusions 216, each protrusion of the multiple protrusions 216 can be coupled at a first end to either the front body rear portion 212 and/or front body rear surface 220 and can be coupled at a second end to either the rear front body portion 214 and/or rear body front surface 217. In other embodiments, only a portion of the multiple protrusions can be coupled at a first end to either the front body rear portion 212 and/or front body rear surface 220 and can be coupled at a second end to either the rear front body portion 214 and/or rear body front surface 217.

For further example, in some embodiments, the front body 107 can be coupled to the rear body 208 by using a screw mechanism. For example, at least one screw can extend from the front body 107 to the rear body 208, or from the rear body 208 to the front body 107. The at least one screw can be positioned in any location, such as near the heel end 106, toe end 105, the top end 101, the bottom end 102, or in any combination of thereof. Further, the front body 107 and rear body 208 can be coupled using any number of screws, such as, two, three, four, or five screws in multiple positions from the heel end 106, toe end 105, the top end 101, the bottom end 102, or in any combination thereof.

For further example, in some embodiments, the front body 107 can be coupled to the rear body 208 by spot welding. For example, at least one spot weld can couple either the front body rear portion 212 and/or front body rear surface 220 to either the rear front body portion 212 and/or rear body front surface 217. The at least one spot weld can be positioned in any location, such as near the heel end 106, toe end 105, the top end 101, the bottom end 102, or in any combination of the described locations. Further, the front body 107 and rear body 208 can be coupled using any number of spot welds, such as, two, three, four, or five spot welds in multiple positions from the heel end 106, toe end 105, the top end 101, the bottom end 102, or in any combination thereof.

For further example, in some embodiments, the front body 107 can be coupled to the rear body 208 using magnets. For example, the front body 107 and rear body 208 can be coupled by positioning at least one magnet on or within the front body 107 and at least one magnet on or within the back body 208 such that the attractive forces between the magnets will couple the two bodies. The at least one magnet can be positioned in any location, such as near the heel end 106, toe end 105, the top end 101, the bottom end 102, or in any combination of the described locations. Further, the front body 107 and rear body 208 can be coupled using any number of magnets, such as, two, three, four, or five magnets in multiple positions from the heel end 106, toe end 105, the top end 101, the bottom end 102, or in any combination thereof.

For further example, in some embodiments, the front body 107 can be coupled to the rear body 208 by use of an adhesive. For example, the adhesive can occupy the entire area between the front body 107 and the back body 208. In further examples, the adhesive can comprise an area between the front body 107 and the filler material 223 and/or an area between the back body 208 and the filler material 223.

For further example, in some embodiments, the front body 107 can be coupled to the rear body 208 by use a polymer plug, adhesive combination. For example, the front body 107 and the rear body 208 can be coupled using at least one polymer plug while also being coupled using an adhesive material as described above. The at least one polymer plug can be positioned in any location, such as near the heel end 106, toe end 105, the top end 101, the bottom end 102, or in any combination thereof. Further, the front body 107 and the rear body 208 can be coupled using any number of polymer plugs, such as, two three, four, or five polymer plugs in multiple positions from the heel end 106, toe end 105, the top end 101, the bottom end 102, or in any combination thereof.

For further example, in some embodiments, the front body 107 can be coupled to the rear body 208 by use of comolding. For example, the filler material 223 can be comolded with the front body 107, the rear body 208, or preferably both. In other embodiments, any combination of the above mentioned coupling mechanisms can be used.

In many embodiments, when front body 107 is coupled to rear body 208 using any of the above mentioned mechanisms, club head 100 can comprise a filler material 223 located between front body 107 and rear body 208. In some embodiments, when multiple protrusions 216 are coupled to rear body front portion 214 and/or rear body front surface 217, the filler material 223 can be in communication with multiple protrusions 216, and/or with front body rear portion 212 and/or front body rear surface 220. In other embodiments, when multiple protrusions 216 are coupled to front body rear portion 212 and/or front body rear surface 220, the filler material 223 can be in communication with multiple protrusions 216, and/or with rear body front portion 214 and/or rear body front surface 217.

For example, the filler material 223 can be located in between (e.g., interspersed between) multiple protrusions 216, such as, for example, at a cavity formed between front body 107 and rear body 208. Further, the filler material 223 can be located in between multiple protrusions 216 and front body 107 (e.g., front body rear portion 212 and/or front body rear surface 220) or in between multiple protrusions 216 and rear body 208 (e.g., rear body front portion 214 and/or rear body front surface 217). In other embodiments, the filler material 223 can be located in between the front body 107 and the back body 208 both devoid of multiple protrusions 216.

In some embodiments, the filler material 223 can comprise an elastic or viscoelastic polymer. In these or other embodiments, the filler material 223 can comprise a non-Newtonian or Newtonian material. In further embodiments the non-Newtonian material may be a dilatant material, or any material having a viscosity that increases with increasing shear rate. In specific embodiments, the filler material 223 can comprise D3O material, manufactured by D3O, The Lab, of Croydon, United Kingdom. Further, in specific embodiments, the filler material 223 can comprise Dow Corning® 3179 Dilatent Compound.

In many embodiments, when the filler material 223 is located between front body 107 and rear body 208, the filler material 223 can hide or block multiple protrusions 216 from view. For example, the filler material 223 can surround and enclose multiple protrusions 216.

When front body 107 is coupled to rear body 208 using any of the above mentioned mechanisms, and when multiple protrusions 216 are coupled to rear body front portion 214 and/or rear body front surface 217, each protrusion of multiple protrusions 216 can extend toward, and in some embodiments, engage (e.g., contact) front body rear portion 212 and/or front body rear surface 220 at a second end of the protrusion opposite the end of the protrusion that is coupled to rear body front portion 214. In further embodiments, the second end of each protrusion of multiple protrusions 216 can extend toward and be proximal to front body rear portion 212 and/or front body rear surface 220 but not engage (e.g., contact) front body rear portion 212 and/or front body rear surface 220 at the second end except for when front body front surface 213 strikes a golf ball and deflects toward multiple protrusions 216 such that multiple protrusions 216 receive front body 107 (e.g., front body rear portion 212 and/or front body rear surface 220) and/or a filler material 223 as described below. In some embodiments, when the second end of each protrusion of multiple protrusions 216 engages front body rear portion 212 and/or front body rear surface 220, the second end can be directly coupled to front body rear portion 212 and/or front body rear surface 220. However, in other embodiments, when the second end of each protrusion of multiple protrusions 216 engages front body rear portion 212 and/or front body rear surface 220, the second end can be separate (e.g., unconnected) from front body rear portion 212 and/or front body rear surface 220. In these or other embodiments, whether rear body front portion 214 comprises or consists of rear body front surface 217, multiple protrusions 216 can extend sufficiently far beyond rear body front surface 217 and/or any other surfaces (e.g., one or more perimeter surface(s)) of rear body front portion 214 to permit multiple protrusions 216 to extend toward and/or engage (e.g., contact) front body rear portion 212 and/or front body rear surface 220.

When front body 107 is coupled to rear body 208 using any of the above mentioned mechanisms, and when multiple protrusions 216 are coupled to front body rear portion 212 and/or front body rear surface 220, each protrusion of multiple protrusions 216 can extend toward, and in some embodiments, engage (e.g., contact) rear body front portion 214 and/or rear body front surface 217 at a second end of the protrusion opposite the end of the protrusion that is coupled to front body rear portion 212. In further embodiments, the second end of each protrusion of multiple protrusions 216 can extend toward and be proximal to rear body front portion 214 and/or rear body front surface 217 but not engage (e.g., contact) rear body front portion 214 and/or rear body front surface 217 at the second end except for when front body front surface 213 strikes a golf ball and deflects toward multiple protrusions 216 such that multiple protrusions 216 receive rear body 107 (e.g., rear body front portion 214 and/or rear body front surface 217) and/or a filler material 223 as described below. In some embodiments, when the second end of each protrusion of multiple protrusions 216 engages rear body front portion 214 and/or rear body front surface 217, the second end can be directly coupled to rear body front portion 214 and/or rear body front surface 217. However, in other embodiments, when the second end of each protrusion of multiple protrusions 216 engages rear body front portion 214 and/or rear body front surface 217, the second end can be separate (e.g., unconnected) from rear body front portion 214 and/or rear body front surface 217. In these or other embodiments, whether front body rear portion 212 comprises or consists of front body rear surface 220, multiple protrusions 216 can extend sufficiently far beyond front body rear surface 220 to permit multiple protrusions 216 to extend toward and/or engage (e.g., contact) rear body front portion 214 and/or rear body front surface 217.

Multiple protrusions 216 can be flexible. Accordingly, when front body 107 is coupled to rear body 208, when multiple protrusions 216 are coupled to rear body front portion 214 and/or rear body front surface 217, and when front body front surface 213 strikes a golf ball (not shown), multiple protrusions 216 can be operable to receive front body 107 (e.g., front body rear portion 212 and/or front body rear surface 220) and/or the filler material 223, and can be configured so that the ends of multiple protrusions 216 that extend toward front body rear portion 212 and/or front body rear surface 220 are able to deflect toward rear body front portion 214 and/or rear body front surface 217, such as, for example, as a result of receiving front body 107 (e.g., front body rear portion 212 and/or front body rear surface 220) and/or the filler material 223. For example, multiple protrusions 216 can be operable to receive the filler material 223 when the filler material 223 is located in between multiple protrusions 216 and front body 107 (e.g., front body rear portion 212 and/or front body rear surface 220). That is, the filler material 223 can be operable as a buffer between multiple protrusions 216 and front body 107 (e.g., front body rear portion 212 and/or front body rear surface 220). In other embodiments, when (i) the filler material 223 is omitted, (ii) the filler material 223 is located only in between multiple protrusions 216 and not between multiple protrusions 216 and front body 107 (e.g., front body rear portion 212 and/or front body rear surface 220), and/or (iii) the filler material 223 is sufficiently compressible to move from in between multiple protrusions 216 and front body 107 (e.g., front body rear portion 212 and/or front body rear surface 220), multiple protrusions 216 can directly receive multiple protrusions 216 and front body 107 (e.g., front body rear portion 212 and/or front body rear surface 220).

Accordingly, because multiple protrusions 216 are configured so that the ends of multiple protrusions 216 that extend toward front body rear portion 212 and/or front body rear surface 220 are able to deflect (e.g., elastically deflect) toward rear body front portion 214 and/or rear body front surface 217, multiple protrusions 216 can be further operable to allow front body 107 (e.g., front body front portion 211 and/or front body front surface 213) to deflect toward rear body front portion 214 and/or rear body front surface 217. As front body 107 (e.g., front body front portion 211 and/or front body front surface 213) deflects toward rear body front portion 214 and/or rear body front surface 217, because multiple protrusions 216 deflect elastically, multiple protrusions 216 can be further operable to reflect (e.g., spring back) and return multiple protrusions 216 and front body 107 to their position prior to front body front surface 213 striking the golf ball. Notably, in many embodiments, less than all of front body 107 and/or multiple protrusions 216 can be deflected and reflected and/or one or more parts of front body 107 and/or multiple protrusions 216 can be deflected and reflected to a lesser extent than one or more other parts of front body 107 and/or multiple protrusions 216 when front body front surface 213 strikes the golf ball. For example, protrusions of multiple protrusions 216 located closer to the point of impact of the golf ball can deflect more than protrusions of multiple protrusions 216 located farther from the point of impact.

Meanwhile, when front body 107 is coupled to rear body 208 using any of the above mentioned mechanisms, when multiple protrusions 216 are coupled to front body rear portion 212 and/or front body rear surface 217, and when front body front surface 213 strikes a golf ball (not shown), multiple protrusions 216 can be operable to receive rear body 208 (e.g., rear body front portion 214 and/or rear body front surface 217) and/or the filler material 223, and can be configured so that the ends of multiple protrusions 216 that extend toward rear body front portion 214 and/or rear body front surface 217 are able to deflect toward front body rear portion 212 and/or front body rear surface 220, such as, for example, as a result of receiving rear body 208 (e.g., rear body front portion 214 and/or rear body front surface 217). For example, multiple protrusions 216 can be operable to receive the filler material 223 when the filler material 223 is located in between multiple protrusions 216 and rear body 208 (e.g., rear body front portion 214 and/or rear body front surface 217). That is, the filler material 223 can be operable as a buffer between multiple protrusions 216 and rear body 208 (e.g., rear body front portion 214 and/or rear body front surface 217). In other embodiments, when (i) the filler material 223 is omitted, (ii) the filler material 223 is located only in between multiple protrusions 216 and not between multiple protrusions 216 and rear body 208 (e.g., rear body front portion 214 and/or rear body front surface 217), and/or (iii) the filler material 223 is sufficiently compressible to move from in between multiple protrusions 216 and rear body 208 (e.g., rear body front portion 214 and/or rear body front surface 217), multiple protrusions 216 can directly receive multiple protrusions 216 and rear body 208 (e.g., rear body front portion 214 and/or rear body front surface 217).

Accordingly, because multiple protrusions 216 are configured so that the ends of multiple protrusions 216 that extend toward rear body front portion 214 and/or rear body front surface 217 are able to deflect (e.g., elastically deflect) toward front body rear portion 212 and/or front body rear surface 220, multiple protrusions 216 can be further operable to allow front body 107 (e.g., front body front portion 211 and/or front body front surface 213) to deflect toward rear body front portion 214 and/or rear body front surface 217. As front body 107 (e.g., front body front portion 211 and/or front body front surface 213) deflects toward rear body front portion 214 and/or rear body front surface 217, because multiple protrusions 216 deflect elastically, multiple protrusions 216 can be further operable to reflect (e.g., spring back) and return multiple protrusions 216 and front body 107 to their position prior to front body front surface 213 striking the golf ball. Notably, in many embodiments, less than all of front body 107 and/or multiple protrusions 216 can be deflected and reflected and/or one or more parts of front body 107 and/or multiple protrusions 216 can be deflected and reflected to a lesser extent than one or more other parts of front body 107 and/or multiple protrusions 216 when front body front surface 213 strikes the golf ball. For example, protrusions of multiple protrusions 216 located closer to the point of impact of the golf ball can deflect more than protrusions of multiple protrusions 216 located farther from the point of impact.

Multiple protrusions 216 can comprise any suitable form or forms permitting multiple protrusions 216 to (i) couple to rear body front portion 214 and/or rear body front surface 217 or to front body rear portion 212 and/or front body rear surface 220, (ii) to extend toward front body rear portion 212 and/or front body rear surface 220 or rear body front portion 214 and/or rear body front surface 217, and (iii) to deflect and reflect in response to receiving front body 107 (e.g., front body rear portion 212 and/or front body rear surface 220) or rear body 208 (e.g., rear body front portion 214 and/or rear body front surface 217). In many embodiments, the forms of two or more (e.g., all) of multiple protrusions 216 can be similar or identical to each other. In these or other embodiments, the forms of two or more of multiple protrusions 216 can be different from each other. For purposes of brevity, the description of exemplary forms, arrangements, and operability of multiple protrusions 216 is described with respect to multiple protrusions 216 coupled to rear body front portion 214 and/or rear body front surface 217, but it should be understood that equivalent examples also can be implemented for multiple protrusions 216 coupled to front body rear portion 212 and/or front body rear surface 220.

In many embodiments, multiple protrusions 216 can be arranged uniformly (e.g., evenly spaced) at rear body front portion 214 and/or rear body front surface 217. In other embodiments, multiple protrusions 216 can be arranged non-uniformly at rear body front portion 214 and/or rear body front surface 217. In these embodiments, at least two of multiple protrusions 216 can be spaced differently than at least two of multiple protrusions 216.

In many embodiments, each protrusion of multiple protrusions 216 can extend curvedly or helically away from rear body front portion 214 and/or rear body front surface 217. In other embodiments, each protrusion of multiple protrusions 216 can extend linearly away from rear body front portion 214 and/or rear body front surface 217.

In some embodiments, the multiple protrusions 216 can be formed directly into the rear front body portion 214 and/or rear body front surface 217 or into the front rear body portion 212 and/or front body rear surface 220 during the casting, machining, printing, forging or any other suitable club manufacturing process. In other embodiments, the multiple protrusions 216 can be formed as separate piece configured to be an insert between the front body 107 and the back body 208. In some embodiments, when viewed from a cross-sectional view, the multiple protrusions 216 can create a z pattern within the insert. In other embodiments, when viewed from a cross-sectional view, the multiple protrusions 216 can form any pattern within the insert. For example, the multiple protrusions 216 can create a square pattern, a circular pattern, a half circle pattern, a diamond pattern, or any other suitable pattern.

In many embodiments, each protrusion of multiple protrusions 216 can comprise a length dimension of the protrusion. The length dimension can refer to a dimension of a protrusion of multiple protrusions 216 extending between the first end of the protrusion coupled to rear body front portion 214 and/or rear body front surface 217 and the second end of the protrusion that is configured to extend toward front body rear portion 212 and/or front body rear surface 220. In some embodiments, the length dimension of the protrusion can be less than 1.3 in, less than 1.2, in less than 1.1 in, less than 1.0 in, less than 0.9 in, less than 0.8 in, less than 0.7 in, less than 0.6 in, less than 0.5 in, less than 0.4 in, less than 0.3 in, less than 0.2 in, or less than 0.1 in. For example, the length dimension can be between 1.5-1.0 in, 1.25-0.75 in, 1.0-0.5 in, 0.75-0.25 in, or 0.5-0 in. The length dimension can be 1.5 in, 1.4 in, 1.3 in, 1.2 in, 1.1 in, 1.0 in, 0.9 in, 0.8 in, 0.7 in, 0.6 in, 0.5 in, 0.4 in, 0.3 in, 0.2 in, or 0.1 in. In some embodiments, the length dimensions of two or more (e.g., all) of multiple protrusions 216 can be similar or identical to each other. In other embodiments, the length dimensions of two or more of multiple protrusions 216 can be different from each other. For example, the length dimension of multiple protrusions 216 can be greater closer to a center of rear body front portion 214 and/or rear body front surface 217 than farther from the center of rear body front portion 214 and/or rear body front surface 217.

Further, in these or other embodiments, each protrusion of multiple protrusions 216 can comprise one or more lateral dimensions. In some embodiments, the lateral dimension(s) can be approximately orthogonal to the length dimension. In some embodiments, the lateral dimension of the protrusion can be less than 0.2 in, less than 0.16 in, less than 0.12 in, less than 0.08 in, or less than 0.04. For example, the lateral dimension can be between 0.2-0.1 in, 0.15-0.5 in, or 0.10-0 in. The lateral dimension can be 0.2 in, 0.16 in, 0.12 in, 0.08 in, or 0.04 in. In some embodiments, one or more of the lateral dimensions of two or more (e.g., all) of multiple protrusions 216 can be similar or identical to each other. In other embodiments, one or more of the lateral dimensions of two or more of multiple protrusions 216 can be different from each other.

In many embodiments, the lateral dimension(s) can comprise a smallest lateral dimension. In these or other embodiments, a ratio of the length dimension to the smallest lateral dimension for one or more (e.g., all) of multiple protrusions 216 can be approximately 4:1, 5:1, 6:1, 7:1, 8:1, or 9:1.

Figure 4:
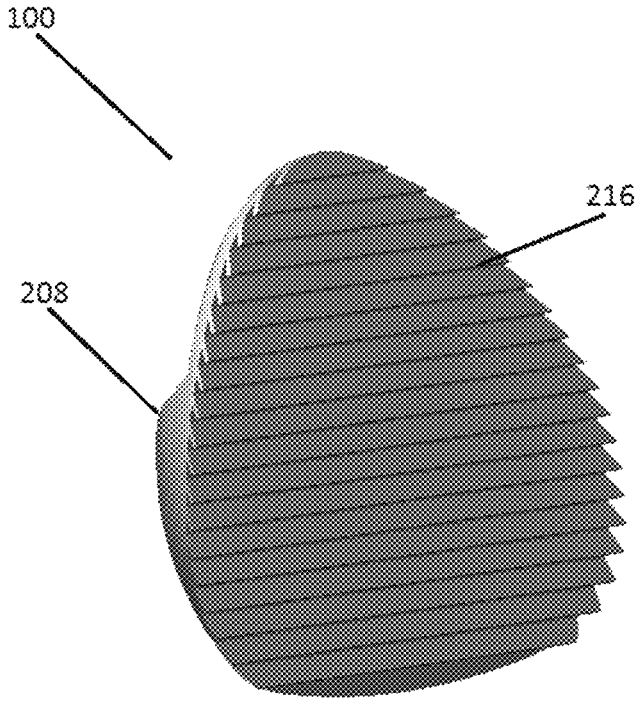
FIG. 4 illustrates a front, toe-side view of a rear body of the club head showing multiple protrusions of the rear body of the club head, according to the embodiment of FIGS. 1-3.

In many embodiments, when multiple protrusions 216 extend linearly away from rear body front portion 214 and/or rear body front surface 217, each protrusion of multiple protrusions 216 can comprise a slat. In some embodiments, the slat can extend laterally in a width dimension from heel end 106 (FIG. 1) to toe end 105 (FIG. 1), and can extend laterally in a thickness dimension orthogonal to the width dimension of the slat and to the length dimension of the protrusion of multiple protrusions 216 corresponding to the slat. In these or other embodiments, the thickness dimension of the slat can comprise the smallest lateral dimension of the protrusion of multiple protrusions 216 comprising the slat. FIG. 4 illustrates a front view of rear body 108 of club head 100 showing multiple protrusions 216, according to the embodiment of FIGS. 1-3.

Meanwhile, although in many embodiments the width dimension of multiple protrusions 216 (e.g., the slats) extend from heel end 106 (FIG. 1) to toe end 105 (FIG. 1) as illustrated at FIG. 4, in other embodiments, the width dimension of multiple protrusions 216 (e.g., the slats) can extend in other directions. For example, in some embodiments, the width dimension can extend between top end 101 and bottom end 102. In further embodiments, the width dimension of multiple protrusions 216 (e.g., the slats) can be angled between toe end 105 or heel end 106 and bottom end 102 at one end and between the other of toe end 105 or heel end 106 and top end 101 at the other end.

Returning again to FIG. 2, in these or other embodiments, each protrusion of multiple protrusions 216 can form an acute angle 224 with rear body front portion 214 and/or rear body front surface 217. Angling multiple protrusions 216 with respect to rear body front portion 214 and/or rear body front surface 217 can permit multiple protrusions 216 to deflect (e.g., elastically deflect) toward rear body front portion 214 and/or rear body front surface 217.

In many embodiments, when multiple protrusions 216 extend linearly away from rear body front portion 214 and/or rear body front surface 217, multiple protrusions 216 can be angled in any suitable direction. In some embodiments, multiple protrusions 216 can be angled toward bottom end 102. Angling multiple protrusions 216 toward bottom end 102 can cause multiple protrusions 216 to deflect upward toward top end 101, which can apply vertical spin (e.g., back spin) to the golf ball responsible for deflecting multiple protrusions 216. The applied vertical spin can be advantageous to increase lifting forces acting on the golf ball, which can result in a quicker landing stop of the golf ball. In other embodiments, multiple protrusions 216 can be angled toward top end 101. In some embodiments, two or more (e.g., all) of multiple protrusions 216 can be angled in directions similar or identical to each other. In other embodiments, two or more of multiple protrusions 216 can be angled in directions different from each other. Adjusting the directions and acute angles 224 of the multiple protrusions 216 can have varying effect on the vertical spin of the golf ball. In some embodiments, the vertical spin can be increased resulting in increased travel height and decreased travel distance. In other embodiments. The vertical spin can be decreased resulting in decreased travel height and increased travel distance of the golf ball can travel.

In many embodiments, the acute angles 224 of multiple protrusions 216 can be less than 90 degrees, less than or equal to approximately 85 degrees, less than or equal to approximately 80 degrees, less than or equal to approximately 75 degrees, less than or equal to approximately 70 degrees, less than or equal to approximately 65 degrees, less than or equal to approximately 60 degrees, less than or equal to approximately 55 degrees, less than or equal to approximately 50 degrees, less than or equal to approximately 45 degrees, less than or equal to approximately 40 degrees, less than or equal to approximately 35 degrees, less than or equal to approximately 30 degrees, less than or equal to approximately 25 degrees, less than or equal to approximately 20 degrees, less than or equal to approximately 15 degrees, less than or equal to approximately 10 degrees, or less than or equal to approximately 5 degrees. For example, in some embodiments, the acute angles 224 of multiple protrusions 216 can be between 20-60 degrees, 30-70 degrees, 40-80 degrees, or 50-90 degrees. In some embodiments, two or more (e.g., all) of the acute angles 224 of multiple protrusions 216 can be similar or identical to each other. In other embodiments, two or more of the acute angles 224 of multiple protrusions 216 can be different from each other.

Front body 107 can comprise a front body material, and rear body 108 can comprise a rear body material. In many embodiments, multiple protrusions 216 can comprise the front body material or the rear body material. However, in other embodiments, multiple protrusions 216 can comprise a different material than part or all of a remainder of rear body 108. In further embodiments, the front body material can be different from the rear body material. In other embodiments, the front body material and the rear body material can be the same material. In these or other embodiments, the front body material and the rear body material can comprise in part or in whole any suitable metal materials including, but not limited to steel, stainless steel, steel alloys, chrome plated steel, tungsten, beryllium nickel, beryllium titanium, titanium alloys, or any combination thereof. In these or other embodiments, the multiple protrusions can comprise in part or in whole any suitable material including but not limited to steel, stainless steel, steel alloy, chrome plated steel, tungsten, beryllium nickel, beryllium copper, titanium, titanium alloys, aluminum, zinc, gallium, tin, bronze, soft metals, polymers, composites, plastics, synthetic rubber, or any combination thereof.

In many embodiments, the filler material 223 can be operable (i) to increase the amount of deflection of multiple protrusions 216 toward rear body 208 (e.g., rear body front portion 214 and/or rear body front surface 217) when multiple protrusions 216 are coupled to rear body 208 (e.g., rear body front portion 214 and/or rear body front surface 217) or (ii) to increase the amount of deflection of multiple protrusions 216 toward front body 107 (e.g., front body rear portion 212 and/or front body rear surface 220) when multiple protrusions 216 are coupled to front body 107 (e.g., front body rear portion 212 and/or front body rear surface 220) as the force with which the golf ball strikes front body front surface 213 decreases, and (a) to decrease the amount of deflection of multiple protrusions 216 toward rear body 208 (e.g., rear body front portion 214 and/or rear body front surface 217) when multiple protrusions 216 are coupled to rear body 208 (e.g., rear body front portion 214 and/or rear body front surface 217) or (b) to decrease the amount of deflection of multiple protrusions 216 toward front body 107 (e.g., front body rear portion 212 and/or front body rear surface 220) when multiple protrusions 216 are coupled to front body 107 (e.g., front body rear portion 212 and/or front body rear surface 220) as the force with which the golf ball strikes front body front surface 213 increases. In these embodiments, the filler material 223 can be configured so that the viscosity of the filler material 223 increases as an applied stress on the filler material 223 increases, and so that the viscosity remains approximately constant or decreases as an applied stress on the filler material 223 decreases. Because the viscosity of the filler material 223 increases as an applied stress on the filler material 223 increases, the filler material 223 increasingly resists deflection of front body 107 and/or multiple protrusions 216 as higher force impacts apply higher stresses to the filler material 223. Meanwhile, because the viscosity of the filler material 223 remains approximately constant or decreases as an applied stress on the filler material 223 decreases, the filler material 223 resists deflection of front body 107 and/or multiple protrusions 216 to a lesser extent. In these or other embodiments, the filler material 223 can be selected to have a viscosity permitting a desirable degree of deflection of front body 107 and/or multiple protrusions 216 for lower force impacts.

In these or other embodiments, club head 100 can be configured such that when front body 107 is coupled to rear body 208, and when front body front surface 213 strikes a golf ball, the amount of deflection of multiple protrusions 216 toward rear body 208 (e.g., rear body front portion 214 and/or rear body front surface 217) when multiple protrusions 216 are coupled to rear body 208 (e.g., rear body front portion 214 and/or rear body front surface 217) or the amount of deflection of multiple protrusions 216 toward front body 107 (e.g., front body rear portion 212 and/or front body rear surface 220) when multiple protrusions 216 are coupled to front body 107 (e.g., front body rear portion 212 and/or front body rear surface 220) decreases as the force with which the golf ball strikes front body front surface 213 increases and the amount of deflection of multiple protrusions 216 toward rear body 208 (e.g., rear body front portion 214 and/or rear body front surface 217) when multiple protrusions 216 are coupled to rear body 208 (e.g., rear body front portion 214 and/or rear body front surface 217) or the amount of deflection of multiple protrusions 216 toward front body 107 (e.g., front body rear portion 212 and/or front body rear surface 220) when multiple protrusions 216 are coupled to front body 107 (e.g., front body rear portion 212 and/or front body rear surface 220) increases as the force with which the golf ball strikes front body front surface 213 decreases. For example, when front body front surface 213 strikes a golf ball with a first amount of force, multiple protrusions 216 can deflect (e.g., elastically deflect) toward rear body 208 (e.g., rear body front portion 214 and/or rear body front surface 217) or toward front body 107 (e.g., front body rear portion 212 and/or front body rear surface 220), as applicable, with a first amount of deflection, and (ii) when front body front surface 213 strikes the golf ball with a second amount of force less than the first amount of force, multiple protrusions 216 can deflect (e.g., elastically deflect) toward rear body 208 (e.g., rear body front portion 214 and/or rear body front surface 217) or toward front body 107 (e.g., front body rear portion 212 and/or front body rear surface 220), as applicable, with a second amount of deflection greater than the first amount of deflection.

Because the amount of deflection of multiple protrusions 216 toward rear body 208 (e.g., rear body front portion 214 and/or rear body front surface 217) or toward front body 107 (e.g., front body rear portion 212 and/or front body rear surface 220), as applicable, decreases as the force with which the golf ball strikes front body front surface 213 increases, a coefficient of restitution (COR) of front body front surface 213 can increase for higher force impacts of the golf ball with front body front surface 213, thereby increasing the travel speed of the golf ball and further the travel distance of the golf ball for higher force impacts. Further, because the amount of deflection of multiple protrusions 216 toward rear body 208 (e.g., rear body front portion 214 and/or rear body front surface 217) or toward front body 107 (e.g., front body rear portion 212 and/or front body rear surface 220), as applicable, decreases as the force with which the golf ball strikes front body front surface 213 increases, multiple protrusions 216 can apply less vertical spin (e.g., back spin) to the golf ball, resulting in less lift force being applied to the golf ball and more travel distance of the golf ball.

Meanwhile, because the amount of deflection of multiple protrusions 216 toward rear body 208 (e.g., rear body front portion 214 and/or rear body front surface 217) or toward front body 107 (e.g., front body rear portion 212 and/or front body rear surface 220), as applicable, increases as the force with which the golf ball strikes front body front surface 213 decreases, the COR of front body front surface 213 can decrease for lower force impacts of the golf ball with front body front surface 213, thereby decreasing the travel speed of the golf ball and further the travel distance of the golf ball for lower force impacts. Further, because the amount of deflection of multiple protrusions 216 toward rear body 208 (e.g., rear body front portion 214 and/or rear body front surface 217) or toward front body 107 (e.g., front body rear portion 212 and/or front body rear surface 220), as applicable, increases as the force with which the golf ball strikes front body front surface 213 decreases, multiple protrusions 216 can apply more vertical spin (e.g., back spin) to the golf ball, resulting in more lift force being applied to the golf ball, and less travel distance of the golf ball.

Accordingly, in these or other embodiments, for higher force impacts of the golf ball with front body front surface 213, club head 100 can perform substantially as though front body 107 and rear body 208 comprise a unitary solid body, such as, for example, similarly or identically to a conventional golf club head. Meanwhile, for lower force impacts of the golf ball with front body front surface 213, club head 100 can advantageously provide for increased control over the golf ball. Consequently, club head 100 can provide differing impact responses (e.g., COR of front body front surface 213 and/or vertical spin of a golf ball hit with club head 100) for higher and lower forces of impact between club head 100 and the golf ball, thereby permitting different golf shots through adjustment of the force of impact between club head 100 and the golf ball.

Figure 5:
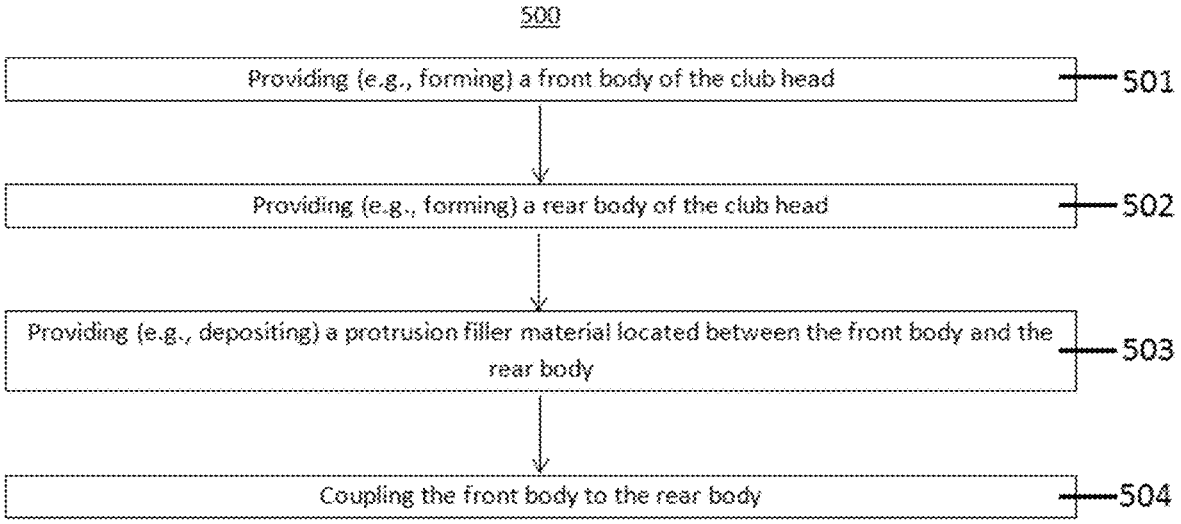
FIG. 5 illustrates an embodiment of a method of providing a club head.

Turning ahead in the drawings, FIG. 5 illustrates an embodiment of a method 500 of providing (e.g., manufacturing) a club head. Method 500 is merely exemplary and is not limited to the embodiments presented herein. Method 500 can be employed in many different embodiments or examples not specifically depicted or described herein. In some embodiments, the activities of method 500 can be performed in the order presented. In other embodiments, the activities of method 500 can be performed in any other suitable order. In still other embodiments, one or more of the activities in method 500 can be combined or skipped. In many embodiments, the club head can be similar or identical to club head 100 (FIGS. 1-4).

Figure 6:
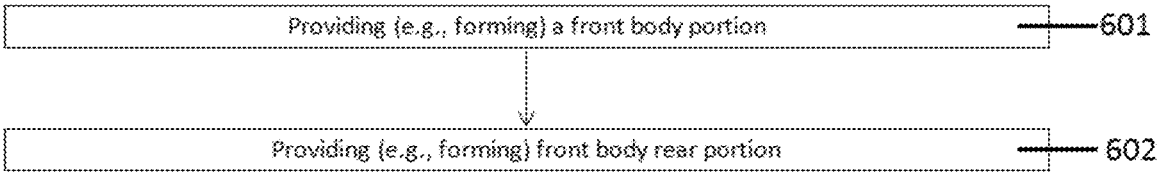
FIG. 6 illustrates an exemplary activity of providing a front body of the club head, according to the embodiment of FIG. 5.

In many embodiments, method 500 can comprise activity 501 of providing (e.g., forming) a front body of the club head. In further embodiments, the front body can be similar or identical to front body 107 (FIGS. 1 & 2). FIG. 6 illustrates an exemplary activity 501, according to the embodiment of FIG. 5.

For example, activity 501 can comprise activity 601 of providing (e.g., forming) a front body front portion. In these or other embodiments, the front body front portion can be similar or identical to front body front portion 211 (FIG. 2). Accordingly, in some embodiments, the front body front portion can comprise a front body front surface. In these embodiments, the front body front surface can be similar or identical to front body front surface 213 (FIG. 2).

Further, activity 501 can comprise activity 602 of providing (e.g., forming) front body rear portion. In these or other embodiments, the front body rear portion can be similar or identical to front body rear portion 212 (FIG. 2). In some embodiments, activity 602 can be performed approximately simultaneously with activity 601. Accordingly, in some embodiments, the front body rear portion can comprise a front body rear surface. In these embodiments, the front body rear surface can be similar or identical to front body rear surface 220 (FIG. 2).

Figure 7:
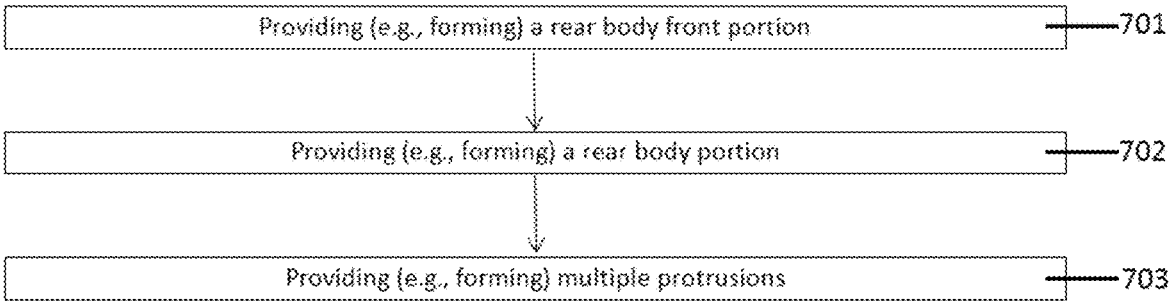
FIG. 7 illustrates an exemplary activity of providing a rear body of the club head, according to the embodiment of FIG. 5.

Turning back to FIG. 5, method 500 can comprise activity 502 of providing (e.g., forming) a rear body of the club head. In further embodiments, the rear body can be similar or identical to rear body 208 (FIGS. 2 & 3). In some embodiments, activity 502 can be performed before or after activity 501. However, in other embodiments, activity 502 can be performed approximately simultaneously with activity 501. FIG. 7 illustrates an exemplary activity 502, according to the embodiment of FIG. 5.

For example, activity 502 can comprise activity 701 of providing (e.g., forming) a rear body front portion. In these or other embodiments, the rear body front portion can be similar or identical to rear body front portion 214 (FIG. 2). Accordingly, in some embodiments, the rear body front portion can comprise a rear body front surface. In these embodiments, the rear body front surface can be similar or identical to rear body front surface 217 (FIG. 2).

Further, activity 502 can comprise activity 702 of providing (e.g., forming) a rear body rear portion. In these or other embodiments, the rear body rear portion can be similar or identical to rear body rear portion 215 (FIG. 2). In some embodiments, activity 702 can be performed approximately simultaneously with activity 701.

Meanwhile, activity 502 can comprise activity 703 of providing (e.g., forming) multiple protrusions. In these or other embodiments, the multiple protrusions can be similar or identical to multiple protrusions 216 (FIGS. 2 & 4). In some embodiments, activity 703 can be performed approximately simultaneously with activity 701 and/or activity 702. In further embodiments, activity 703 can be performed as part of activity 702. In other embodiments, activity 703 can be performed after activity 701 and/or activity 702. In still further embodiments, activity 703 can be part of activity 501 or part of both of activities 501 and 502.

Turning now back to FIG. 5, in many embodiments, method 500 can comprise activity 503 of providing (e.g., depositing) a filler material 223 located between the front body and the rear body. The filler material 223 can be similar or identical to the filler material 223 described above with respect to club head 100 (FIGS. 1-4). In some embodiments, activity 504 can be performed before activity 503.

Further, method 500 can comprise activity 504 of coupling the front body to the rear body. In these or other embodiments, performing activity 504 can be similar or identical to coupling the front body to the rear body as described above with respect to club head 100 (FIGS. 1-4). For example, in some embodiments, performing activity 504 can comprise welding the front body to the rear body.

In many embodiments, one or more of activities 501, 502, 601, 602, and 701-703 can be performed using one or more metallurgic techniques including casting, molding, forging, machining, drilling, laser cutting, etc. In these or other embodiments, two or more of activities 501, 502, 601, 602, and 701-703 can be performed using the same metallurgic techniques, and/or two or more of activities 501, 502, 601, 602, and 701-703 can be performed using different metallurgic techniques.

Although the club head(s) and related methods herein have been described with reference to specific embodiments, various changes may be made without departing from the spirit or scope of the present disclosure. For example, to one of ordinary skill in the art, it will be readily apparent that method 500 (FIG. 5) and/or one or more activities of method 500 (FIG. 5) may be comprised of many different activities and be performed by many different modules, and in many different orders, that any element of FIGS. 1-5 may be modified, and that the foregoing discussion of certain of these embodiments does not necessarily represent a complete description of all possible embodiments.

Further, while the above examples may be described in connection with an iron-type golf club head, the apparatus, methods, and articles of manufacture described herein may be applicable to other types of golf clubs such as a wood-type golf club or a putter-type golf club. Alternatively, the apparatus, methods, and articles of manufacture described herein may be applicable other type of sports equipment such as a hockey stick, a tennis racket, a fishing pole, a ski pole, etc.

Additional examples of such changes and others have been given in the foregoing description. Other permutations of the different embodiments having one or more of the features of the various figures are likewise contemplated. Accordingly, the specification, claims, and drawings herein are intended to be illustrative of the scope of the disclosure and is not intended to be limiting. It is intended that the scope of this application shall be limited only to the extent required by the appended claims.

The golf club heads and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

Clause 1. A golf club head comprising:

a top end and a bottom end opposite the top end, a front end and a rear end opposite the front end, a toe end and a heel end opposite the toe end, a front body comprising a front body front portion comprising a front body front surface, and a front body rear portion opposite the front body front portion, the front body front portion located closer to the front end than the front body rear portion, a rear body comprising a rear body front portion comprising a rear body front surface, and a rear body rear portion opposite the rear body front portion, the rear body rear portion located closer to the rear end than the rear body front portion, and multiple protrusions, wherein each protrusion of the multiple protrusions comprises a first end and a second end opposite the first end, the second end of the each protrusion of the multiple protrusions is coupled to the rear body front portion at the rear body front surface or the front body rear portion at the front body rear surface, the front body is configured to be coupled to the rear body, when the front body is coupled to the rear body, when the second end of the each protrusion of the multiple protrusions is coupled to the rear body front portion at the rear body front surface, the each protrusion extends away from the rear body front portion toward the front body rear portion, when the second end of the each protrusion of the multiple protrusions is coupled to the front body rear portion at the front body rear surface, the each protrusion extends away from the front body rear portion toward the rear body front portion, and the golf club head is configured such that when the second end of the each protrusion of the multiple protrusions is coupled to the rear body front portion at the rear body front surface, and when the front body front surface strikes a golf ball with a first amount of force, the multiple protrusions deflect toward the rear body with a first amount of deflection, when the second end of the each protrusion of the multiple protrusions is coupled to the front body rear portion at the front body rear surface, and when the front body front surface strikes a golf ball with a second amount of force, the multiple protrusions deflect toward the front body with a second amount of deflection, when the second end of the each protrusion of the multiple protrusions is coupled to the rear body front portion at the rear body front surface, and when the front body front surface strikes the golf ball with a third amount of force, the multiple protrusions deflect toward the rear body with a third amount of deflection, when the second end of the each protrusion of the multiple protrusions is coupled to the front body rear portion at the front body rear surface, and when the front body front surface strikes the golf ball with a fourth amount of force, the multiple protrusions deflect toward the rear body with a fourth amount of deflection, the first amount of force is greater than the third amount of force, the second amount of force is greater than the fourth amount of force, the first amount of deflection is less than the third amount of deflection; and the second amount of deflection is less than the fourth amount of deflection.

Clause 2. The golf club head of clause 1 wherein, the front body is coupled to the rear body, and the golf club head further comprises a filler material located between the front body and the rear body, wherein the filler material is in communication with the multiple protrusions.

Clause 3. The golf club head of clause 1 wherein, the filler material comprises a dilatant non-Newtonian material.

Clause 4. The golf club head of clause 1 wherein, the multiple protrusions comprise a first protrusion forming a first angle with the rear body front surface, and the first angle is less than 90 degrees.

Clause 5. The golf club head of clause 1 wherein the multiple protrusions comprise a first protrusion forming a first angle with the rear body front surface, and the first angle is less than or equal to approximately 45 degrees.

Clause 6. The golf club head of clause 1 wherein the multiple protrusions comprise:

a first protrusion forming a first angle with the rear body front surface or the front body rear surface, and a second protrusion forming a second angle with the rear body front surface or the front body rear surface, the first angle and the second angle each are less than 90 degrees, and the first angle and the second angle are different from each other.

Clause 7. The golf club head of clause 1 wherein, the each protrusion of the multiple protrusions comprises:

a length dimension extending between the first end and the second end, and a smallest lateral dimension being approximately perpendicular to the length dimension, and a ratio of the length dimension to the smallest lateral dimension is at least approximately 4:1.

Clause 8. The golf club head of clause 1 wherein, the each protrusion of the multiple protrusions comprises a length dimension extending between the first end and the second end, the multiple protrusions comprise a first protrusion and a second protrusion, and the length dimension of the first protrusion is different than the length dimension of the second protrusion.

Clause 9. The golf club head of clause 1 wherein, the each protrusion of the multiple protrusions extends linearly away from the rear body front portion toward the front body rear portion.

Clause 10. The golf club head of clause 1 wherein, the front body comprises a front body material, the rear body comprises a rear body material, and the multiple protrusions comprise the rear body material or the front body material.

Clause 11. The golf club head of clause 10 wherein, the front body material is different than the rear body material.

Clause 12. The golf club head of clause 1 wherein, the multiple protrusions comprise multiple slats.

Clause 13. A method of providing a golf club head, the method comprising:

providing a front body of the golf club head, and providing a rear body of the golf club head, wherein, the golf club head comprises a top end and a bottom end opposite the top end, a front end and a rear end opposite the front end, and a toe end and a heel end opposite the toe end, providing the front body comprises providing a front body front portion comprising a front body front surface, and providing a front body rear portion opposite the front body front portion, the front body front portion being located closer to the front end than is the front body rear portion, providing the rear body comprises providing a rear body front portion comprising a rear body front surface, providing a rear body rear portion opposite the rear body front portion, the rear body rear portion being located closer to the rear end than is the rear body front portion, and providing multiple protrusions, each protrusion of the multiple protrusions comprises a first end and a second end opposite the first end, the second end of the each protrusion of the multiple protrusions is coupled to the rear body front portion at the rear body front surface or the front body rear portion at the front body rear surface, the front body is configured to be coupled to the rear body, when the front body is coupled to the rear body when the second end of the each protrusion of the multiple protrusions is coupled to the rear body front portion at the rear body front surface, the each protrusion extends away from the rear body front portion toward the front body rear portion, when the second end of the each protrusion of the multiple protrusions is coupled to the front body rear portion at the front body rear surface, the each protrusion extends away from the front body rear portion toward the rear body front portion, and the golf club head is configured such that when the second end of the each protrusion of the multiple protrusions is coupled to the rear body front portion at the rear body front surface, and when the front body front surface strikes a golf ball with a first amount of force, the multiple protrusions deflect toward the rear body with a first amount of deflection, when the second end of the each protrusion of the multiple protrusions is coupled to the front body rear portion at the front body rear surface, and when the front body front surface strikes a golf ball with a second amount of force, the multiple protrusions deflect toward the front body with a second amount of deflection, when the second end of the each protrusion of the multiple protrusions is coupled to the rear body front portion at the rear body front surface, and when the front body front surface strikes the golf ball with a third amount of force, the multiple protrusions deflect toward the rear body with a third amount of deflection, and when the second end of the each protrusion of the multiple protrusions is coupled to the front body rear portion at the front body rear surface, and when the front body front surface strikes the golf ball with a fourth amount of force, the multiple protrusions deflect toward the rear body with a fourth amount of deflection, the first amount of force is greater than the third amount of force, the second amount of force is greater than the fourth amount of force, the first amount of deflection is less than the third amount of deflection, and the second amount of deflection is less than the fourth amount of deflection.

Clause 14. The method of clause 13 further comprising providing a filler material located between the front body and the rear body, the filler material being in communication with the multiple protrusions.

Clause 15. The method of clause 13 further comprising providing a filler material located between the front body and the rear body, the filler material being in communication with the multiple protrusions and comprising a dilatant non-Newtonian material.

Clause 16. The method of clause 13 further comprising coupling the front body to the rear body.

Clause 17. The method of claim 16 wherein coupling the front body to the rear body comprises welding the front body to the rear body.

Clause 18. A golf club head comprising:

a top end and a bottom end opposite the top end, a front end and a rear end opposite the front end, a toe end and a heel end opposite the toe end, a front body comprising a front body front portion comprising a front body front surface, and a front body rear portion opposite the front body front portion, the front body front portion being located closer to the front end than is the front body rear portion, and a rear body comprising a rear body front portion comprising a rear body front surface, and a rear body rear portion opposite the rear body front portion, the rear body rear portion being located closer to the rear end than is the rear body front portion wherein the front body is configured to be coupled to the rear body when the front body is coupled to the rear body the golf club head is configured such that when the front body front surface strikes a golf ball with a first amount of force, the front body front portion deflects toward the rear body with a first amount of deflection, and when the front body front surface strikes the golf ball with a second amount of force, the front body front portion deflects toward the rear body with a second amount of deflection the first amount of force is greater than the second amount of force, and the first amount of deflection is less than the second amount of deflection.

Clause 19. The golf club head of clause 1 further comprising multiple protrusions, each protrusion of the multiple protrusions comprises a first end and a second end opposite the first end, the second end of the each protrusion of the multiple protrusions is coupled to the rear body front portion at the rear body front surface or to the front body rear portion at the front body rear surface, and the first end is closer to the bottom end than is the second end.

Clause 20. The golf club head of clause 19 further comprising the front body is coupled to the rear body, and the golf club head further comprises a filler material located between the front body and the rear body, wherein the filler material is in communication with the multiple protrusions, and the filler material comprises a dilatant non-Newtonian material.

Generally, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claim.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:
a top end and a bottom end opposite the top end;
a front end and a rear end opposite the front end;
a toe end and a heel end opposite the toe end;
a strikeface comprising a striking surface, and
a rear surface opposite and rearward of the striking surface,
a rear body comprising an internal front surface; and
multiple protrusions;
wherein:
each protrusion of the multiple protrusions comprises a first end and a second end opposite the first end;
the first end of each protrusion of the multiple protrusions is coupled only to the internal front surface of the rear body and extends away from the rear body toward the strikeface;
the second end of each protrusion is not engaged with the strikeface and is proximal to the strikeface rear surface;
wherein each protrusion of the multiple protrusions has a length measured as the distance from the first end of each protrusion to the second end of each protrusion;
wherein each protrusion of the multiple protrusions comprises a solid slat;
wherein the rear body comprises a rear body material selected from the group consisting of: steel, stainless steel, steel alloys, chrome-plated steel, tungsten, beryllium nickel, beryllium titanium, and titanium alloys;
wherein the multiple protrusions comprise the rear body material;
wherein each of the solid slats has a width dimension measured laterally from the toe end to the heel end of the golf club head;
wherein each of the solid slats has a thickness dimension orthogonal to the width dimension;
wherein the strike face is entirely separate from the rear body and indirectly coupled to the rear body by a filler material;
and
the golf club head is configured such that:
when the striking surface impacts a golf ball with a first amount of force, the multiple protrusions deflect toward the rear body internal front surface with a first amount of deflection and the multiple protrusions extend towards the strikeface rear surface.

2. The golf club head of claim 1 wherein:
the filler material is in communication with the multiple protrusions.

3. The golf club head of claim 2 wherein:
the filler material comprises a dilatant non-Newtonian material.

4. The golf club head of claim 1 wherein:
the multiple protrusions comprise a first protrusion forming a first angle with the rear body internal front surface; and
the first angle is less than 90 degrees.

5. The golf club head of claim 1 wherein:
the multiple protrusions comprise a first protrusion forming a first angle with the rear body internal front surface; and
the first angle is less than or equal to approximately 45 degrees.

6. The golf club head of claim 1 wherein:
the multiple protrusions comprise:
a first protrusion forming a first angle with the rear body internal front surface or the strikeface rear surface; and
a second protrusion forming a second angle with the rear body internal front surface or the strikeface rear surface;
the first angle and the second angle each are less than 90 degrees; and
the first angle and the second angle are different from each other.

7. The golf club head of claim 1 wherein:
each protrusion of the multiple protrusions comprises:
a smallest lateral dimension being approximately perpendicular to the length of the protrusion;
and
a ratio of the length to the smallest lateral dimension is at least approximately 4:1.

8. The golf club head of claim 1 wherein:
the multiple protrusions comprise a first protrusion and a second protrusion; and
the length of the first protrusion is different than the length of the second protrusion.

9. The golf club head of claim 1 wherein:
each protrusion of the multiple protrusions extends linearly away from the rear body internal front surface toward the strikeface.

10. The golf club head of claim 1 wherein:
the rear body comprises a rear body material; and
the strikeface material is different than the rear body material.

11. A golf club head comprising:
a top end and a bottom end opposite the top end;
a front end and a rear end opposite the front end;
a toe end and a heel end opposite the toe end;
a strikeface comprising a striking surface, and
a rear surface opposite and rearward of the striking surface,
a rear body comprising an internal front surface; and
multiple protrusions;
wherein:
each protrusion of the multiple protrusions comprises a first end and a second end opposite the first end;

the first end of each protrusion of the multiple protrusions is coupled only to the internal front surface of the rear body and extends away from the rear body toward the strikeface;

the second end of each protrusion is not engaged with the strikeface and is proximal to the strikeface rear surface;

wherein each protrusion of the multiple protrusions has a length measured as the distance from the first end of each protrusion to the second end of each protrusion;

wherein the length of the multiple protrusions is greater closer to a center of the rear body internal front surface than a perimeter of the internal front surface; wherein the strike face is entirely separate from the rear body and indirectly coupled to the rear body by a filler material; and the golf club head is configured such that:

when the striking surface impacts a golf ball with a first amount of force, the multiple protrusions deflect toward the rear body internal front surface with a first amount of deflection and the multiple protrusions extend towards the strikeface rear surface.

12. The golf club head of claim 11 wherein:

the filler material is in communication with the multiple protrusions.

13. The golf club head of claim 12 wherein:

the filler material comprises a dilatant non-Newtonian material.

14. The golf club head of claim 11 wherein:

the multiple protrusions comprise a first protrusion forming a first angle with the rear body internal front surface; and the first angle is less than 90 degrees.

15. The golf club head of claim 11 wherein:

the multiple protrusions comprise a first protrusion forming a first angle with the rear body internal front surface; and the first angle is less than or equal to approximately 45 degrees.

16. The golf club head of claim 11 wherein:

the multiple protrusions comprise:

a first protrusion forming a first angle with the rear body internal front surface or the strikeface rear surface; and a second protrusion forming a second angle with the rear body internal front surface or the strikeface rear surface;

the first angle and the second angle each are less than 90 degrees; and the first angle and the second angle are different from each other.

17. The golf club head of claim 11 wherein:

each protrusion of the multiple protrusions comprises:

a smallest lateral dimension being approximately perpendicular to the length of the protrusion;

and a ratio of the length to the smallest lateral dimension is at least approximately 4:1.

18. The golf club head of claim 11 wherein:

the multiple protrusions comprise a first protrusion and a second protrusion; and the length of the first protrusion is different than the length of the second protrusion.

19. The golf club head of claim 11 wherein:

each protrusion of the multiple protrusions extends linearly away from the rear body internal front surface toward the strikeface.

20. The golf club head of claim 11 wherein:

the rear body comprises a rear body material; and the strikeface material is different than the rear body material.

* * * * *